US005642136A

United States Patent [19]

Jayavant et al.

[11] Patent Number: 5,642,136

[45] Date of Patent: Jun. 24, 1997

[54] METHOD AND APPARATUS FOR SCREEN REFRESH BANDWIDTH REDUCTION FOR VIDEO DISPLAY MODES

[75] Inventors: Rajeev Jayavant; William Desi Rhoden, both of Phoenix, Ariz.

[73] Assignee: VLSI Technology, Inc., San Jose, Calif.

[21] Appl. No.: 661,404

[22] Filed: Jun. 7, 1996

Related U.S. Application Data

[63] Continuation of Ser. No. 163,418, Dec. 6, 1993, abandoned.

[51] Int. Cl.[6] ..... G09G 5/24

[52] U.S. Cl. ..... 345/194; 345/141; 345/150; 345/192; 395/167

[58] Field of Search ..... 345/141, 143, 345/192, 193, 194, 150; 395/150, 167

[56] References Cited

U.S. PATENT DOCUMENTS

| | | | |
|---|---|---|---|
| 4,646,077 | 2/1987 | Culley | 345/194 |
| 4,716,405 | 12/1987 | Yamaguchi | 345/194 |
| 4,837,564 | 6/1989 | Ogawa et al. | 345/194 |
| 4,847,787 | 7/1989 | Nishiyama et al. | 345/194 |
| 5,323,175 | 6/1994 | Doi et al. | 345/194 |

OTHER PUBLICATIONS

Richard R. Ferraro, *Programmer's Guide to the EGA and VGA Cards,* Addison–Wesley Publishing Company, Inc., 1990, pp. 182–227.

James D. Foley, et al., *Computer Graphics Principles and Practice,* Additon–Wesley Publishing Company, Inc., 1987, pp. 164–187.

*Primary Examiner*—Richard Hjerpe
*Assistant Examiner*—Kent Chang
*Attorney, Agent, or Firm*—Douglas L. Weller

[57] ABSTRACT

In a text mode of a display controller, for each character of the text, a plurality of multiple-byte words are stored in a memory buffer. Each multiple-byte word contains an ASCII character code for the character, font attribute information for the character and at least one font line for the character. For each character font line to be displayed on the monitor, a multiple byte word is read. The attribute information and a first character font line are extracted from the multiple byte word. The display controller then constructs a character scan line for the character based on the attribute information and the first character font line. The character scan line may then be displaying on the monitor.

21 Claims, 6 Drawing Sheets

METHOD AND APPARATUS FOR SCREEN REFRESH BANDWIDTH REDUCTION FOR VIDEO DISPLAY MODES

This application is a continuation of application Ser. No. 08/163,418, filed Dec. 6, 1993, now abandoned.

BACKGROUND

The present invention concerns a graphics controller for a computer, and more specifically, a method and apparatus for providing for efficient use of a memory within a data frame buffer to reduce refresh bandwidth for a video display.

In a computer display system in which a graphics controller is used in the display of information on a video monitor, a video display mode defines the transformations required to convert the contents of frame buffer memory of a graphics device into pixel data that can be displayed by a monitor. The simplest display modes directly read the red, green, and blue intensity values of the pixel from the frame buffer, while more complex display modes may perform several frame buffer accesses for each pixel or set of pixels.

One classic example of a complex video display mode is the text mode of the Video Graphics Array (VGA) controller commonly found in the Personal Computer (PC) marketplace. For example, the frame buffer memory in a standard VGA controller configured for text mode operation may typically be configured so that four maps each contain 64K bytes. The VGA controller accesses the four maps in parallel, reading or writing one byte from each map with each memory access. The first map (Map 0) contains ASCII eight bit character codes. The second map (Map 1) contains attribute bytes for the corresponding ASCII character. The attribute byte for each character specifies properties such as color, blinking, and underline. The third map (Map 2) contains a font table. The ASCII eight bit characters codes stored in Map 0 are an index into the font table in Map 2. The font table includes scan line information for each ASCII character. For a typical prior art application, the ASCII eight bit character codes in Map 0 and the associated attribute bytes in Map 1 take up only 16K bytes. Thus the upper 48K of maps 0 and 1 are unused in the text modes. The fourth map (Map 3) also is unused.

In the prior art, a typical VGA controller performs the following actions to produce a displayable image on a monitor (i.e. during screen refresh). First, the VGA controller reads an ASCII/attribute pair from Map 0 and Map 1 in memory. Next, the VGA controller uses the ASCII value obtained from Map 0 and row scan number to compute an address into the font memory map. The row scan number comes from the CRT controller (monitor timing generator). This is used to read a one byte font line from the font table in Map 2. The font line is equivalent to one scan line of the character. Finally, the 8 bits of font lines from the font table in Map 2 is translated into 8 or 9 pixels based on attribute, ASCII value, and controller configuration. In the 9 pixel wide font modes, the ninth pixel is formed by replicating the eighth pixel for ASCII values in a given range, otherwise the ninth pixel is set to the background color.

One key advantage to this standard VGA implementation is the density of information storage. Each character requires only two bytes of storage, regardless of the height of the font. The standard VGA provides access to 16K characters, for a total of 32 KB of memory. The font line information requires N bytes per character, where N is the height of a character. In the standard VGA, the font line information is capable of describing eight character sets of 256 characters each, 32 scan lines high for requiring a total of 64 kilobytes (KB) of storage (8 character sets times 256 characters per character set times 32 bytes per character).

One major disadvantage to this standard VGA implementation is that the screen refresh operation requires a minimum of two sequential read operations per character since the ASCII value obtained by the first read is required to determine the address of the font line obtained in the second read.

The necessity for two reads is particularly painful for more recent systems which are pushing the cost and performance barriers. For example, higher resolution and/or higher refresh rate displays increase the pixel rate that must be sustained to maintain an image on the monitor. These pixel rates are already greater than the bandwidths that can be supported by simple accesses to DRAM, requiring the use of on-chip memory to buffer multiple reads that can take advantage of DRAM page mode operation. Even with the use of on-chip memory buffers, the limits of DRAM bandwidth are in sight.

Also, the bandwidth required for screen refresh reduces the bandwidth available for frame buffer accesses from the CPU. Graphics subsystem performance can be severely impacted as the available CPU bandwidth decreases. The issue of CPU bandwidth is a much greater concern in newer systems that seek to lower system cost by utilizing a single memory subsystem for both system memory and frame buffer. The screen refresh operation now steals bandwidth from system memory accesses as well as frame buffer accesses.

A traditional solution to reducing screen refresh bandwidth requirements has been to use Video RAM (VRAM) instead of DRAM. VRAM provides a separate serial port that can be used to provide pixel data to the monitor. Unfortunately, the serial port can only provide data from sequential locations in memory, making it impossible to perform the second read required to look up the font data.

SUMMARY OF THE INVENTION

In accordance with the preferred embodiment of the present invention, a method and a display controller are presented. In a text mode of a display controller, for each character of the text, a plurality of multiple-byte words are stored in a memory buffer. Each multiple-byte word contains an ASCII character code for the character, font attribute information for the character and at least one font line for the character. For each character font line to be displayed on the monitor, a multiple byte word is read. The attribute information and a first character font line are extracted from the multiple byte word. The display controller then constructs a character scan line for the character based on the attribute information and the first character font line. The character scan line may then be displaying on the monitor.

In the preferred embodiment of the present invention, when storing information in the memory buffer, an ASCII character and/or font attribute are received from a system central processing unit (CPU). The ASCII character code is used to retrieve font lines describing the character. For example, these are previously stored in a font reference area within the memory buffer. The ASCII character code and the font lines are placed in the plurality of multiple-byte words so that the ASCII character code is stored in each multiple-byte word from the plurality of multiple-byte words and each font line is stored in only one multiple-byte word from the plurality of multiple-byte words. For example, in one embodiment of the present invention, each multiple-byte word is a four-byte word. Each of the four-byte word contains an ASCII character code for the character, font attribute information for the character and two font lines for the character. In the preferred embodiment of the present invention, each character is described by 15 multiple-byte words, each containing two font lines for the character.

The preferred embodiment of the present invention provides the functionality of standard VGA text modes while making significantly different tradeoffs between screen refresh bandwidth, memory requirements, and CPU frame buffer access overhead. Overall system memory bandwidth is maximized by reducing the bandwidth for screen refresh. The preferred embodiment has several advantages over the prior art. For example, in the preferred embodiment, screen refresh overhead is reduced by at least a factor of 2 over standard VGA text mode implementations. VRAM serial ports can be used for screen refresh, completely freeing the random access port for CPU access. This compares with prior art VGA implementations which must perform at least one read from the random port (if the serial port is used for reading font attribute data). Most prior art systems perform two reads from the random port.

Further, the preferred embodiment of the present invention provides for partial data formatting as the data is written to the frame buffer. The preferred embodiment of the present invention allows for minimization of the frequency with which the frame buffer data needs to be reformatted due to changes in the graphics controller configuration. Further, the preferred embodiment is fully compatible with VGA panning and line compare operations, providing very fast scrolling and split screen operation.

DESCRIPTION OF THE PREFERRED EMBODIMENT

Figure 1:
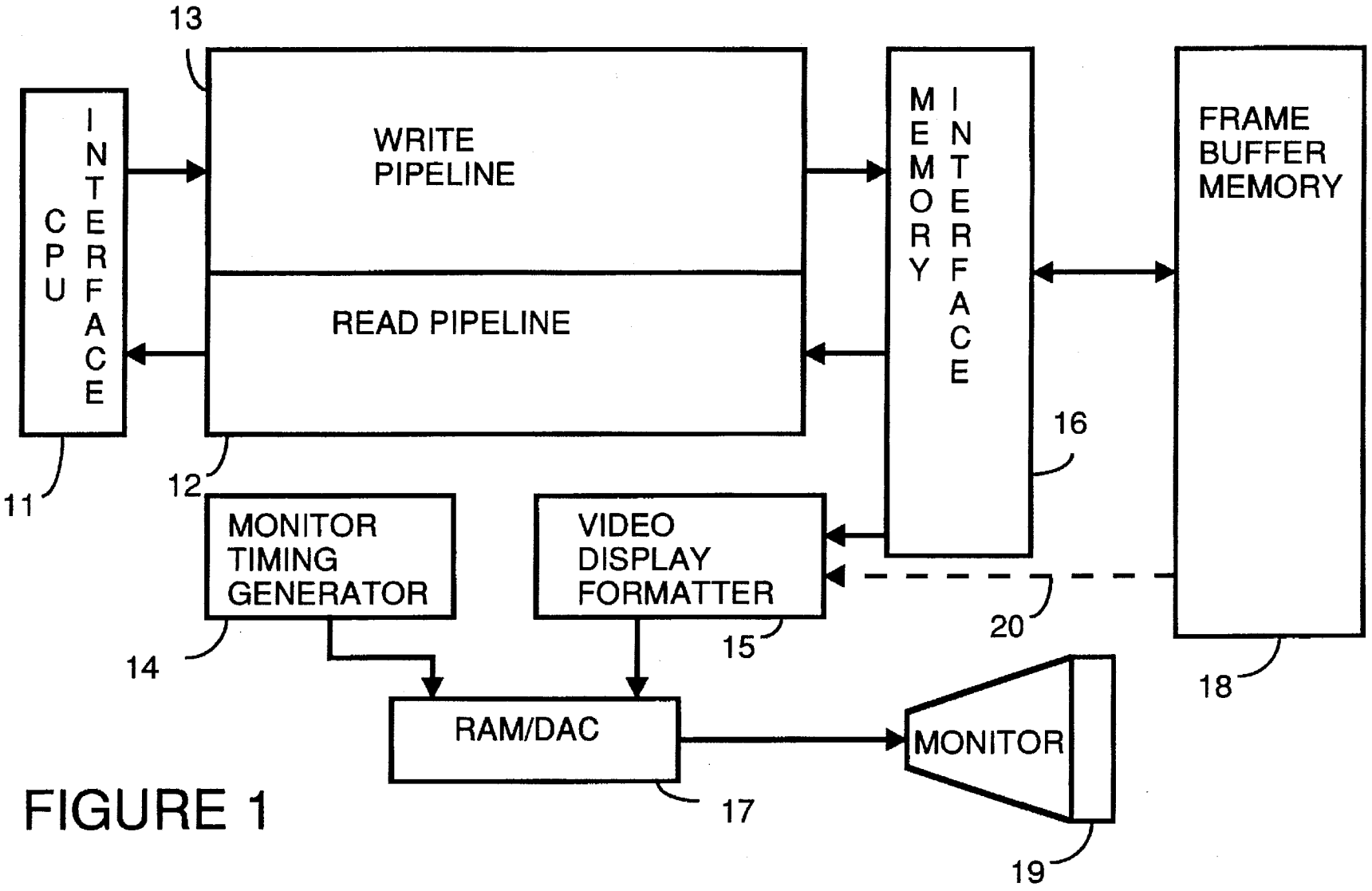
FIG. 1 shows implementation of a display system in accordance with the preferred embodiment of the present invention.

FIG. 1 shows implementation of a display system. A frame buffer memory 18 buffers information which describes a screen displayed on a monitor 19. In addition, in "off-screen" portions of frame buffer memory 18 not used for screen description, pattern information is stored. This information may be used by a write pipeline 13 when preparing description of the screen to be stored in frame buffer memory 18.

A CPU interface 11 is used to interface the display system with the central processor system (CPU). When the CPU changes the screen description information within frame buffer memory 18, software drivers running on the CPU forward new screen display information to the display system through CPU interface 11. This new screen display information typically includes, assuming text mode, a memory location in the frame buffer memory and the ASCII character code and/or attribute value to be written to the memory location. From the new screen display information, a write pipeline 13 writes new screen description into frame buffer memory 18. All interaction between write pipeline 13 and frame buffer memory 18 is done through a memory interface 16.

The information within frame buffer memory may also be accessed by a read pipeline 12 through memory interface 16. The information may be forwarded to the CPU through CPU interface 11.

The screen display within frame buffer memory is formatted by a video display formatter 15. Video display formatter 15 receives the pixels from the screen display from frame buffer memory 18 through memory interface 16 as shown in FIG. 1. Alternately, video display formatter may receive the pixels from the screen display directly from frame buffer memory 18 via an optional VRAM serial port represented by a path 20. RAMDAC circuitry 17, which includes RAM and digital to analog converters, generates RGB analog signals which are used to drive monitor 19. In generating the RGB analog signals, RAMDAC circuitry 17 uses synchronization signals generated by a monitor timing generator 14.

Figure 2:
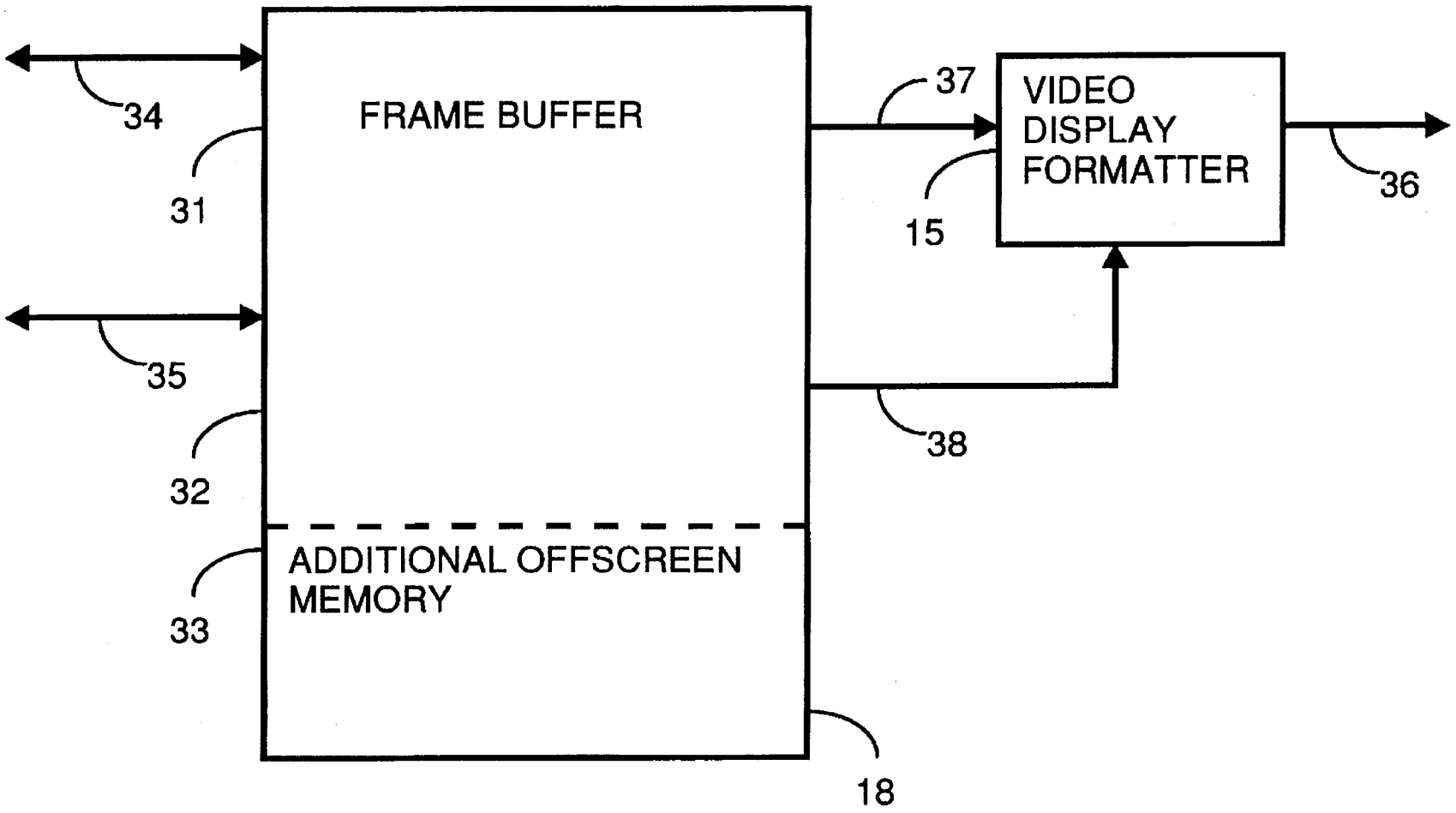
FIGURE 2 (PRIOR ART)
FIG. 2 and FIG. 3 illustrate storage and formatting within a VGA graphics system in accordance with the prior art.
Figure 3:
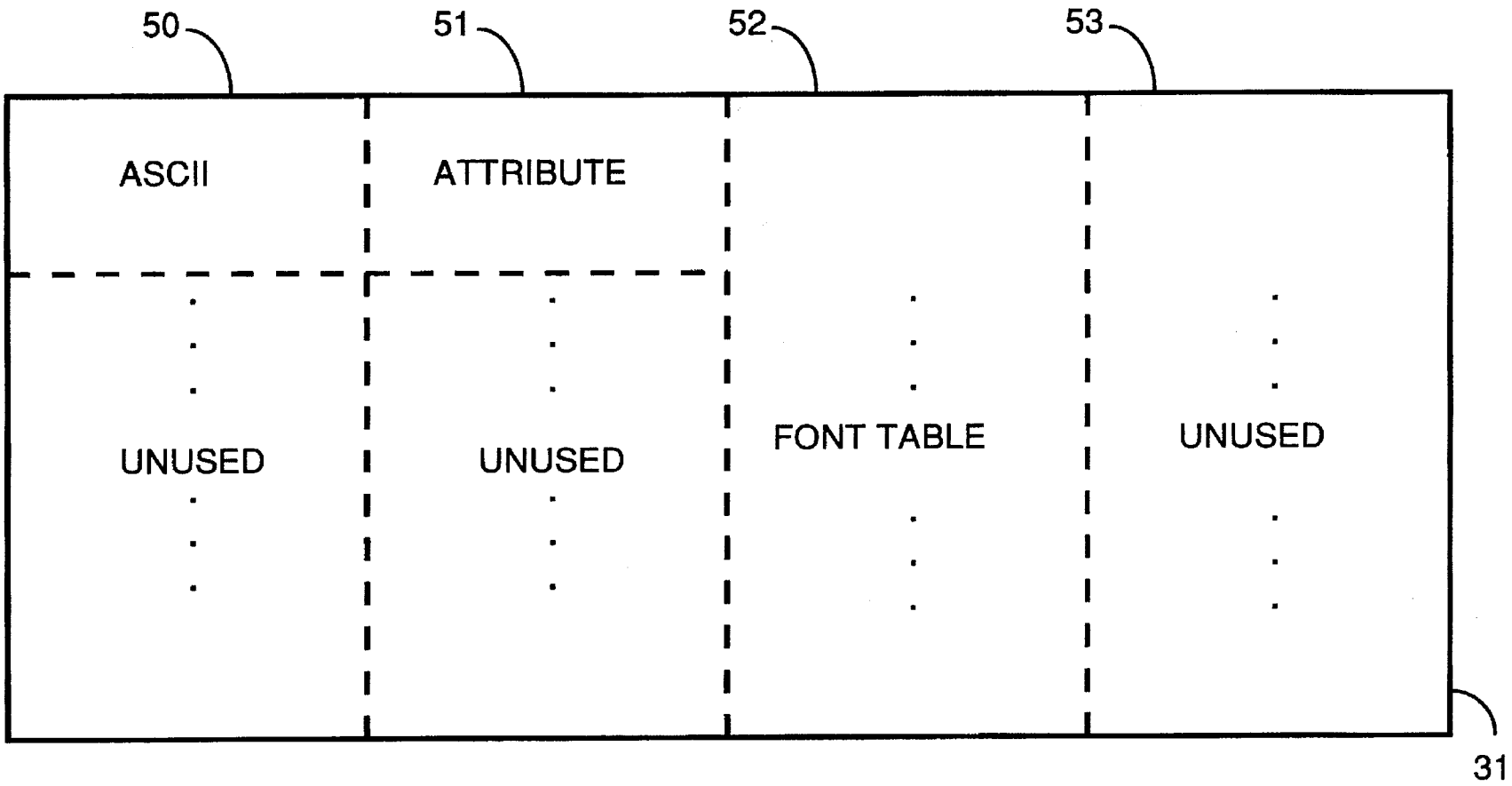
FIGURE 3 (PRIOR ART)

FIG. 2 and FIG. 3 illustrate storage and formatting within a VGA graphics system in accordance with the prior art. In FIG. 2, frame buffer memory 18 is shown divided into a frame buffer portion 31 and additional off screen memory 33 portion. Frame buffer portion 31 typically provides 256 kilobytes (KB) of memory storage. For text mode, CPU generated storage and retrieval of ASCII characters and font attributes is represented by a data path 34. CPU generated storage and retrieval of font tables is represented by a data path 35. Data path 34 and data 35 typically use the same physical channel.

Typically, in the prior art, for each frame buffer scan line used for screen refresh of a full scan line of data across display monitor 19, video display formatter 15 reads each character within the frame buffer scan line. Video display formatter 15, for each character of the full width scan line, reads an ASCII/attribute pair in frame buffer 31, as represented by a data path 37. Next, video display formatter 15 uses the ASCII value obtained from frame buffer 31 and the character row number (tracked by video display formatter 15) to compute an address into the font table, also located within frame buffer 31. The address is used to read a one byte font line from the font table. The font line describes one scan line of information for the character. Finally, the 8 bits of font line from the font table is translated into 8 or 9 pixels based on the font attribute, ASCII value, and controller configuration. In the 9 pixel wide font modes, the ninth pixel is formed by replicating the eighth pixel for ASCII values in a given range, otherwise the ninth pixel is set to the background color. The font is forwarded to the video display formatter along a data path 38. Data path 37 and data 38 typically use the same physical channel. On many systems data path 34, data path 35, data path 37 and data path 38 all share the same physical channel.

In the prior art, each character can have up to 32 font lines (character rows). Therefore, provided video display formatter keeps track of character row numbers, 32 frame buffer scan lines can be represented by a single frame buffer scan line of ASCII/font attribute pairs. By using each frame buffer scan line 32 times, there is significant memory savings.

FIG. 3 shows a typical configuration of frame buffer 31 for text mode operation in the prior art. A map 50, a map 51, a map 52 and a map 53 each contain 64K bytes of memory locations. The VGA controller accesses the four maps in parallel, reading or writing one byte from each map with each memory access. The first 16 KB of map 50 contains ASCII eight bit character codes for data to be displayed on monitor 19. The remaining 48 KB of map 50 is unused. The first 16 KB of map 51 contains font attribute bytes for the corresponding ASCII character in map 50. The font attribute byte for each character specifies properties such as color, blinking, and underline. The remaining 48 KB of map 50 is unused. The entire 64 KB of map 52 contains a font table. The ASCII eight bit characters codes stored in map 50 are an index into the font table in map 52. The font table includes font line information for each ASCII character. Map 53 is unused.

Figure 4:
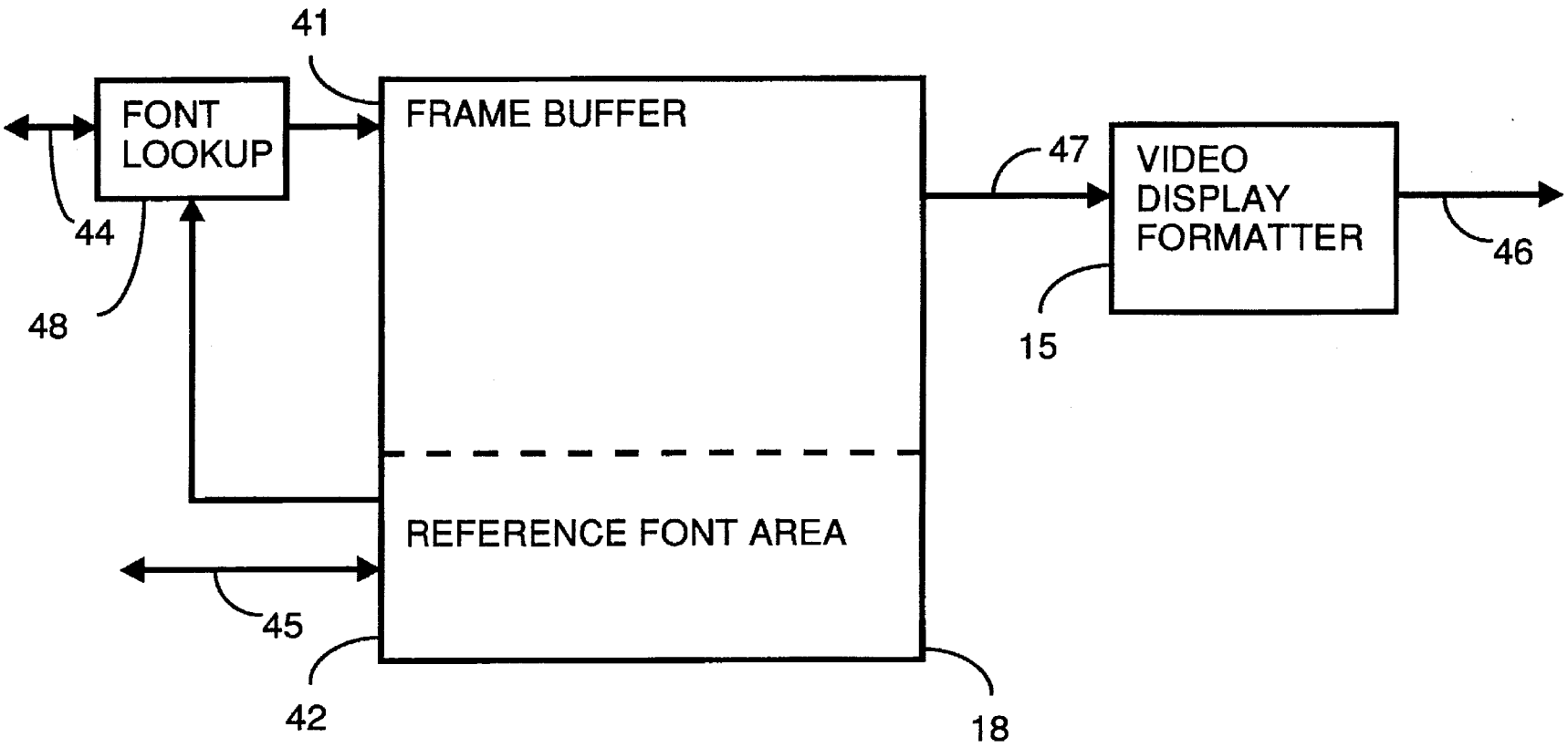
FIG. 4 and FIG. 5 illustrate storage and formatting within a VGA graphics system in accordance with the preferred embodiment of the present invention.
Figure 5:
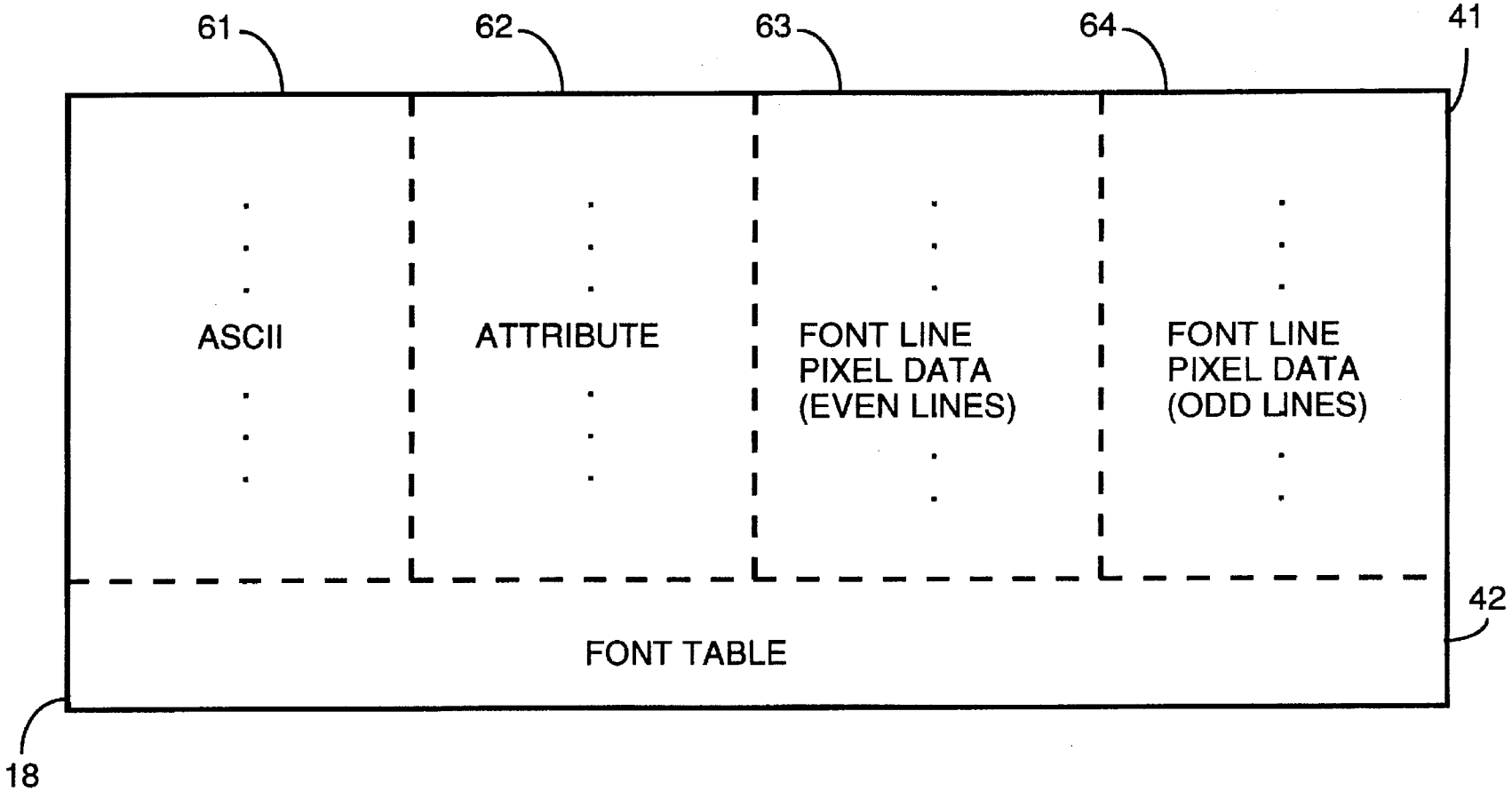

FIG. 4 and FIG. 5 illustrate storage and formatting within a VGA graphics system in accordance with a preferred embodiment of the present invention. In FIG. 4, frame buffer memory 18 is shown divided into a frame buffer portion 41 and a font reference area 42. Frame buffer portion 41 contains, for example, 960 KB memory locations. Frame buffer portion 42 contains, for example, 64 KB memory locations.

For text mode, a font table is stored in font reference area 42. Within the font table, 32 eight bit font lines are stored for each character. CPU generated storage into and retrieval from the font table is represented by a data path 45.

CPU generated storage of ASCII characters and font attributes into frame buffer 41 is represented by a data path 44. Data within data path 44 generally includes an ASCII/font attribute pair. Font lookup logic 48 uses the ASCII value to compute an address into the font table within font reference area 42. The address is used to read the 32 bytes of font information 32 font lines) from the font table. The 32 bytes of font information is used to generate the thirty font lines placed in frame buffer 41. The bottom two bytes of the original 32 bytes of font information are ignored in the preferred embodiment of the present invention. Font lookup logic 42 places the font lines in the appropriate location within frame buffer 41, as discussed below. In frame buffer portion 41 each 32-bit word contains, a one byte ASCII, value, a one byte associated font attribute and two font lines.

Font lookup circuitry 48 converts a single ASCII or font attribute write through the following series of operations. If only ASCII is specified, font lookup circuitry 48 reads the existing value of the font attribute from the frame buffer 41. If only the font attribute is specified, font lookup circuitry 48 reads the existing value of ASCII from frame buffer 41. This read may be skipped if both ASCII and the font attribute are specified via a 16-bit write. Font lookup circuitry 48 uses the ASCII value, font select registers, and the optional font select bit within the font attribute to compute an address into font reference area 42. Font reference area 42 contains 32 bytes per character, just like the standard VGA, except that the font lines are stored across all four maps. This packing system allows the 32 bytes for each font to be accessed with only 8 reads.

Font lookup circuitry 48 then performs a bit block transfer (Bitblt) to copy the ASCII, the font attribute, and font lines into 15 segments within frame buffer 41. The ASCII and the font attribute are replicated into all 15 segments, while the copy of font lines copies 30 bytes from font reference area 42 writing 2 bytes of font lines for each of the 15 segments).

Thus writing to the frame buffer for the preferred embodiment of the present invention is quite a bit more expensive than for the standard VGA case; however, the overall penalty is insignificant compared to the bandwidth regained during the screen refresh process. Furthermore, the write penalty can be minimized in a number of ways. First, if only the font attribute is changed and the font select bit within the font attribute has been disabled, there is no need to Bitblt the font. All that is required is to copy the font attribute value to all 15 segments in the frame buffer memory—similar to a rectangle fill operation.

Each segment contains data for two rows of a character. If the screen refresh process is programmed to display characters that are N rows high, only the first (N+1)/2 segments will ever be accessed. In most cases, there is no need to write to all 15 segments, only (N+1)/2.

Higher performance Bitblt engines provide intermediate storage for read data, allowing the font data to be read in one burst operation from memory. Row/column mappings can be utilized to maximize the effectiveness of page mode writes.

Font accesses are typically handled only via the BIOS routines and do not have to conform to an existing access method. All that is required is a mechanism by which the highest 64K of frame buffer memory is directly mapped into CPU memory space. The CPU can then access reference font area 42 as a generic memory region.

Since the frame buffer now contains data that is partially formatted (i.e. the font lookup is performed when the ASCII/font attribute values are written), there are a few cases in which the frame buffer data will become invalid and require re-computation. Any operations that alter the font lookup process will force a re-computation.

In the preferred embodiment of the present invention, when performing a screen refresh, for each frame buffer scan line used to construct a full scan line of data across display monitor 19, video display formatter 15 reads each character within the frame buffer scan line. Video display formatter 15, for each character of the full width scan line, reads an ASCII/font attribute pair and two font lines, as represented by a data path 47. Depending on the character row line, one of the font lines from the font table is translated into 8 or 9 pixels based on the font attribute, ASCII value, and controller configuration. In the 9 pixel wide font modes, the ninth pixel is formed by replicating the eighth pixel for ASCII values in a given range, otherwise the ninth pixel is set to the background color.

In the preferred embodiment, each 32-bit word within frame buffer portion 41 includes an ASCII/font attribute pair and two font lines. Therefore, 15 frame buffer scan lines are required to fully describe a row of characters. Since each frame buffer scan line may be used only two times, there is significant increase in memory usage over the prior art.

FIG. 5 shows a configuration of frame buffer 41 for text mode operation in the preferred embodiment of the present invention. A map 60, a map 61, a map 62 and a map 63 each contain 240K bytes of memory locations. The VGA controller accesses the four maps in parallel, reading or writing one byte from each map with each memory access. Map 60 contains ASCII eight bit character codes for data to be displayed on monitor 19. Map 61 contains font attribute bytes for the corresponding ASCII character in map 60. The font attribute byte for each character specifies properties such as color, blinking, and underline. Map 62 contains font lines for even numbered rows of the character. Map 63 contains font lines for odd numbered rows of the character. The font table is included in a separate region 42 which includes 64 KB (16K 32-bit words).

In the memory configuration shown two rows of characters are stored in 16 KB. Thus a thirty font-line character is stored in fifteen of the 16 KB segments. The ASCII and font attribute values are effectively replicated for all 15 segments, but the pixel data is unique. Since there are a total of 15 segments, this implementation supports fonts that are up to 30 scan lines high. Considering that the VGA standard only allows characters up to 9 pixels wide, the 30 scan line height limitation should not be a problem for any aesthetically-pleasing font.

Figure 6:
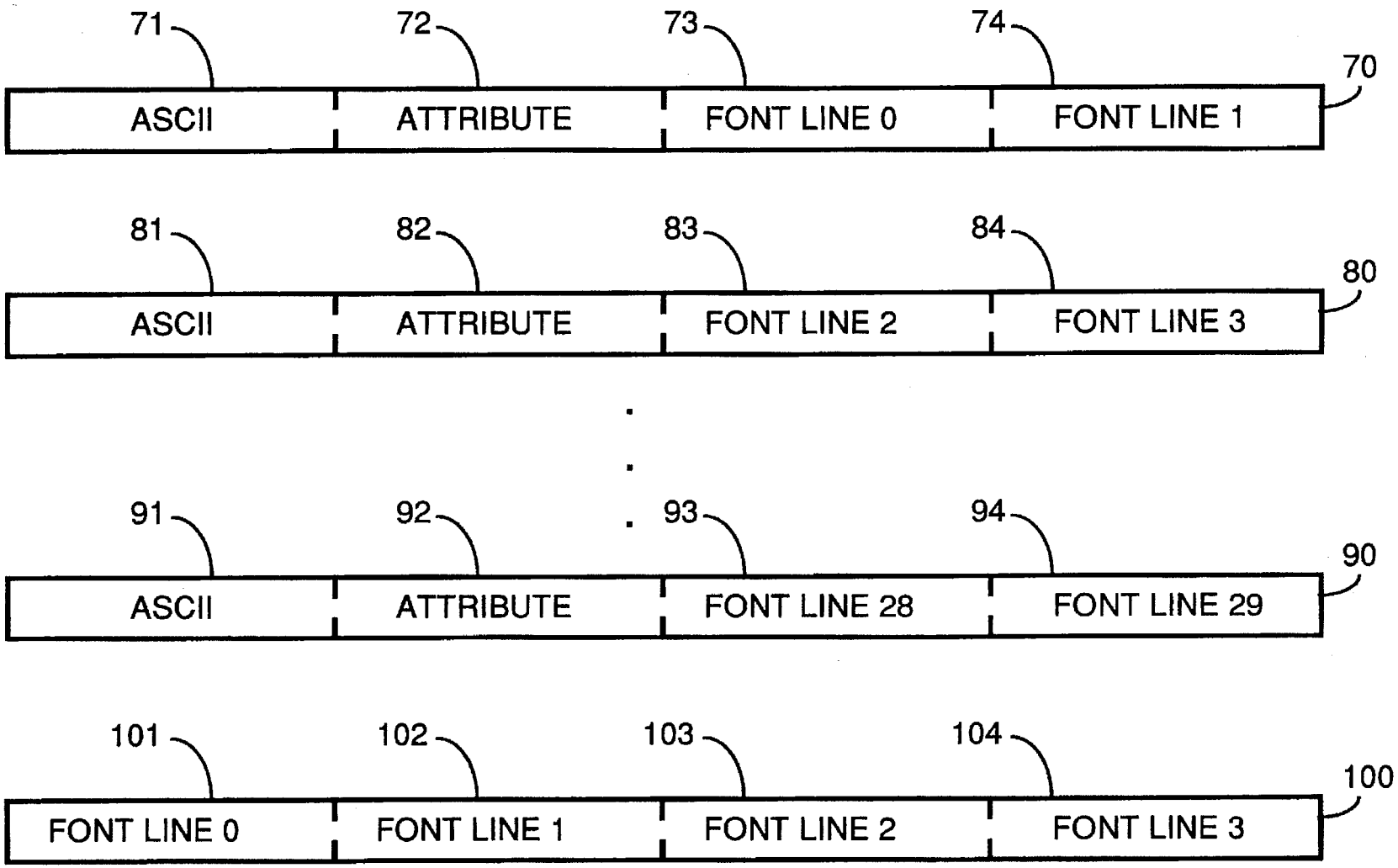
FIG. 6 illustrates formatting of words obtained from a frame buffer shown in FIG. 5 in accordance with the preferred embodiment of the present invention.

FIG. 6 shows an example of words read from frame buffer 18. For example, for a frame buffer scan line which includes a first or second font line row, it is necessary to read only one word per character from frame buffer 18. Each word 70 includes an eight bit ASCII code 71, an eight bit font attribute 72, a font line 73 for row 0 (font line 0) of the character and a font line 74 for row 1 (font line 1) of the character. Word 70 is read when either font line 0 or when font line 1 is being prepared for display on monitor 19.

For a frame buffer scan line which includes a third or fourth font line row, it is necessary to read only one word per character from frame buffer 18. Each word 80 includes an eight bit ASCII code 81, an eight bit font attribute 82, a font line 83 for row 2 (font line 2) of the character and a font line 84 for row 3 (font line 3) of the character. Word 80 is read when either font line 2 or when font line 3 is being prepared for display on monitor 19.

For a frame buffer scan line which includes a twenty-ninth or thirtieth font line row, it is necessary to read only one word per character from frame buffer 18. Each word 90 includes an eight bit ASCII code 91, an eight bit font attribute 92, a font line 93 for row twenty-eight (font line 28) of the character and a font line 94 for row twenty-nine (font line 29) of the character. Word 90 is read when either font line 28 or when font line 29 is being prepared for display on monitor 19.

Word 100 illustrates organization of words within font table 42. Each word 100 includes four font lines. For example, word 100 is shown to have a font line 101 for row 0 (font line 0) of the character, a font line 102 for row 1 (font line 1) of the character, a font line 103 for row 2 (font line 2) of the character and a font line 104 for row 3 (font line 3) of the character.

The system described here solves many of the problems associated with the standard VGA text mode implementations by taking advantage of the increased memory available in mainstream graphics subsystems today. In addition, much of the hardware required to implement this solution can be shared with a Bitblt engine, a common requirement in mainstream systems.

In the preferred embodiment of the present invention, the screen refresh process requires a single read per character, effectively cutting the screen refresh bandwidth requirements in half. The bandwidth reduction is even more dramatic when the impacts on DRAM page mode operation are taken into account. Since adjacent characters are stored in sequential addresses, VRAM serial ports can be used to virtually eliminate screen refresh bandwidth requirements on the VRAM's random access port.

While FIG. 5 illustrates a preferred embodiment for memory mapping of frame buffer 18, other memory mappings could be used in accordance with the present invention, only provided that scan line information is included along with the attributes in the same word line. The ASCII code is included in the same word line to assist in calculating the ninth pixel bit where the ninth pixel bit is required.

In the preferred embodiment, in order to remain compatible with existing VGA hardware, all CPU accesses to the frame buffer memory emulate the behavior of standard VGA devices. There are four basic types of accesses that are considered when dealing with VGA text modes: ASCII/attribute read, ASCII/attribute write, font read, and font write.

The preferred embodiment of the present invention provides the functionality of standard VGA text modes while making significantly different tradeoffs between screen refresh bandwidth, memory requirements, and CPU frame buffer access overhead. Overall system memory bandwidth is maximized by reducing the largest bandwidth consumer—screen refresh. The advantages of the preferred embodiment include the following. Screen refresh overhead is reduced by at least a factor of 2 over standard VGA text mode implementations. VRAM serial ports can be used for screen refresh, completely freeing the random access port for CPU access. This compares with prior art VGA implementations which must perform at least one read from the random port (if the serial port is used for reading ASCII/font attribute data). Most perform two reads from the random port. Data is partially formatted as it is written to the frame buffer. The preferred embodiment of the present invention allows for minimization of the frequency with which the frame buffer data needs to be reformatted due to changes in the graphics controller configuration. Further, the preferred embodiment is fully compatible with VGA panning and line compare operations, providing very fast scrolling and split screen operation.

Although the preferred embodiment described above uses the VGA text mode, as will be understood by persons of ordinary skill in the art, the present invention is applicable to other display modes that require multiple frame buffer accesses. The data can be pre-formatted before being written to the frame buffer, reducing the number of reads required for screen refresh operations, and the hardware required for pre-formatting may be shared with other functions within the device.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A method for refreshing a display displayed on a monitor, comprising:

(a) storing in a memory buffer for each character a plurality of multiple-byte words, each multiple-byte word containing at least one font line for the character and in addition to the font line, font attribute information wherein each font line for the character is a single scan line for the character and the font attribute information is the same for each multiple-byte word in the plurality of multiple-byte words for the character, wherein each multiple-byte word is a set of bytes which are placed contiguous to one another within the memory buffer and wherein the font attribute information is contained in at least one byte of the set of bytes;

(b) for each character font line to be displayed on the monitor, reading a multiple byte word;

(c) from the multiple byte word read in step (b) extracting the attribute information and a first character font line;

(d) constructing a character scan line for the character based on the attribute information and the first character font line extracted in step (c); and, (e) displaying on the monitor the character scan line constructed in step (d).

2. A method as in claim 1 wherein step (a) includes storing in the plurality of multiple-byte words for each character an ASCII character code for the character wherein the ASCII character code applies to the entire character and is the same for each multiple-byte word in the plurality of multiple-byte words.

3. A method as in claim 2 wherein step (a) comprises the following substeps:

(a.1) receiving the ASCII character;

(a.2) using the ASCII character code to retrieve font lines describing the character;

(a.3) placing the ASCII character code and the font lines in the plurality of multiple-byte words so that the ASCII character code is stored in each multiple-byte word from the plurality of multiple-byte words and each font line is stored in only one multiple-byte word from the plurality of multiple-byte words.

4. A method as in claim 3 wherein step (a.2) includes retrieving font lines from a font reference area within the memory buffer.

5. A method as in claim 4 additionally comprising the following step performed before step (a):

(f) storing font lines in the font reference area within the memory buffer.

6. A method as in claim 2 wherein in step (a) each multiple-byte word is a four-byte word, each of the four-byte word containing an ASCII character code for the character, font attribute information for the character and two font lines for the character.

7. A method as in claim 6 wherein in step (a) the plurality of multiple-byte word contains 15 multiple-byte words.

8. A display controller which displays characters on a monitor comprising:

a buffer memory;

storing means, coupled to the buffer memory, for storing in the buffer memory for each character a plurality of multiple-byte words, each multiple-byte word containing at least one font line for the character and in addition to the font line, font attribute information wherein each font line for the character is a single scan line for the character and the font attribute information is the same for each multiple-byte word in the plurality of multiple-byte words for the character, wherein each multiple-byte word is a set of bytes which are placed contiguous to one another within the memory buffer and wherein the font attribute information is contained in at least one byte of the set of bytes; and, screen refresh means, coupled to the buffer memory, for displaying the characters on the monitor, the screen refresh means obtaining font lines for the characters by reading the multiple-byte words stored in the buffer memory by the storing means.

9. A display controller as in claim 8 wherein the storing means additionally stores in the plurality of multiple-byte words for each character, an ASCII character code for the character wherein the ASCII character code applies to the entire character and is the same for each multiple-byte word in the plurality of multiple-byte words.

10. A display controller as in claim 9 wherein the storing means uses a received ASCII character code to retrieve font lines describing the character and places the received ASCII character code and the font lines in the plurality of multiple-byte words so that the ASCII character code is stored in each multiple-byte word from the plurality of multiple-byte words and each font line is stored in only one multiple-byte word from the plurality of multiple-byte words.

11. A display controller as in claim 10 wherein the buffer memory includes a font reference area from which the storing means retrieves font lines.

12. A display controller as in claim 9 wherein each multiple-byte word is a four-byte word, each of the four-byte word containing an ASCII character code for a character, font attribute information for the character and two font lines for the character.

13. A display controller as in claim 12 wherein 15 multiple-byte words are used to contain all the font lines for each character.

14. A method for storing, in a buffer memory, screen refresh information for use in displaying characters on a screen, the method comprising the step of:

(a) storing in the buffer memory for each character a plurality of multiple-byte words, each multiple-byte word containing at least one font line for the character and in addition to the font line, font attribute information wherein each font line for the character is a single scan line for the character and the font attribute information is the same for each multiple-byte word in the plurality of multiple-byte words, wherein each multiple-byte word is a set of bytes which are placed contiguous to one another within the memory buffer and wherein the font attribute information is contained in at least one byte of the set of bytes.

15. A method as in claim 14 wherein step (a) comprises the following substeps:

(a.1) receiving an ASCII character code and the font attribute for the character;

(a.2) using the ASCII character code to retrieve font lines describing the character;

(a.3) placing font attribute for the character and the font lines in the plurality of multiple-byte words so that the font attribute is stored in each multiple-byte word from the plurality of multiple-byte words and each font line is stored in only one multiple-byte word from the plurality of multiple-byte words.

16. A method as in claim 15 wherein step (a.2) includes retrieving font lines from a font reference area within the buffer memory.

17. A method as in claim 16 additionally comprising the following step performed before step (a):

(b) storing font lines in the font reference area within the buffer memory.

18. A method as in claim 14 wherein step (a) each multiple-byte word additionally contains an ASCII character code for the character.

19. A method as in claim 18 wherein in step (a) each multiple-byte word is a four-byte word, each of the four-byte word containing an ASCII character code for the character, font attribute information for the character and two font lines for the character.

20. A method as in claim 14 wherein in step (a) for each character the plurality of multiple-byte word contains 15 multiple-byte words.

21. A method for storing, in a buffer memory, screen refresh information for use in displaying characters on a screen, the method comprising the step of:

(a) storing in the buffer memory for each character a plurality of multiple-byte words, each multiple-byte word containing at least one font line for the character and in addition to the font line, an ASCII character code for the character, wherein each font line for the character is a single scan line for the character and the ASCII character code is the same for each multiple-byte word in the plurality of multiple-byte words, wherein each multiple-byte word is a set of bytes which are placed contiguous to one another within the memory buffer and wherein the font attribute information is contained in at least one byte of the set of bytes.

* * * * *